United States Patent [19]

Tanner et al.

[11] 4,171,992

[45] Oct. 23, 1979

[54] PREPARATION OF ZIRCONIUM ALLOYS CONTAINING TRANSITION METAL ELEMENTS

[75] Inventors: Lee E. Tanner, Summit; Ranjan Ray, Morristown, both of N.J.

[73] Assignee: Allied Chemical Corporation, Morris Township, Morris County, N.J.

[21] Appl. No.: 892,617

[22] Filed: Apr. 3, 1978

Related U.S. Application Data

[62] Division of Ser. No. 823,080, Aug. 9, 1977, Pat. No. 4,113,478.

[51] Int. Cl.[2] ..... C22F 1/18

[52] U.S. Cl. ..... 148/3; 148/13

[58] Field of Search ..... 75/134 F, 177, 122; 148/3, 13

[56] References Cited

U.S. PATENT DOCUMENTS

| | | | |
|---|---|---|---|
| 3,660,082 | 5/1972 | Negishi et al. | 75/134 F |
| 3,856,513 | 12/1974 | Chen et al. | 75/122 |
| 3,862,658 | 1/1975 | Bedell | 164/87 |
| 3,871,836 | 3/1975 | Polk et al. | 75/122 |

OTHER PUBLICATIONS

Ray et al, "The Constitution of Metastable Ti-rich Ti-Fe Alloys: An Order-Disorder Transition", Met. Trans., vol. 3, pp. 627-629, (1972).

Varich et al, "Metastable Phases in Binary Ni Alloys Crystallized During Rapid Cooling", Phys. of Met. & Metallography, No. 2, vol. 33, pp. 335-338, (1972).

Ray et al, "New Non-Crystalline Phases in Splat Cooled Transition Metal Alloys", Scripta Metallurgic, pp. 357-359, (1968).

Polesya et al, "Formation of Amorphous Phases and Metastable Solid Solutions in Binary Ti and Zr Alloys with Fe, Ni, Co", Izvestia Akadameta Nauk SSSR Metals, pp. 173-178, (1973).

*Primary Examiner*—Arthur J. Steiner

*Attorney, Agent, or Firm*—Ernest D. Buff; Gerhard H. Fuchs

[57] ABSTRACT

Zirconium alloys containing at least two of the transition metal elements of iron, cobalt and nickel are disclosed. The alloys consist essentially of at least two elements selected from the group consisting of about 1 to 27 atom percent iron, about 1 to 43 atom percent cobalt and about 1 to 42 atom percent nickel, balance essentially zirconium plus incidental impurities. The alloys in polycrystalline form are capable of being melted and rapidly quenched to the glassy state. Substantially totally glassy alloys of the invention evidence unusually high resistivities of over 200 $\mu\Omega$-cm.

3 Claims, 3 Drawing Figures

PREPARATION OF ZIRCONIUM ALLOYS CONTAINING TRANSITION METAL ELEMENTS

This is a division of application Ser. No. 823,080, filed Aug. 9, 1977, now U.S. Pat. No. 4,113,478.

BACKGROUND OF THE INVENTION

1. Field of the Invention

This invention relates to zirconium-base alloys containing transition metal elements.

2. Description of the Prior Art

Materials having high electrical resistivity (over 200 $\mu\Omega$-cm) and negative or zero temperature coefficients of resistivity are required for precision resistors, resistance thermometers and the like. High resistivity materials permit fabrication of smaller resistors. Negative temperature coefficients of resistivity provide larger resistance values at lower temperatures, thus increasing the sensitivity of low temperature resistance thermometers. Zero temperature coefficients of resistivity provide stability of resistance with temperature which is required for useful precision resistors. Commonly available alloys such as Constantan (49 $\mu\Omega$-cm) and Nichrome (100 $\mu\Omega$-cm) are examples of materials generally employed in these applications.

A number of splat-quenched foils of binary alloys of zirconium and titanium with transition metals such as nickel, copper, cobalt and iron have been disclosed elsewhere; see, e.g. Vol. 4, *Metallurgical Transactions,* pp. 1785–1790 (1973) (binary Zr-Ni alloys); *Izvestia Akadameya Nauk SSSR, Metals,* pp. 173–178 (1973) (binary Ti or Zr alloys with Fe, Ni or Cu); and Vol. 2, *Scripta Metallurgica,* pp. 357–359 (1968) (binary Zr-Ni, Zr-Cu, Zr-Co and Ti-Cu alloys). While metastable, non-crystalline single phase alloys are described in these references, no useful properties of these materials are disclosed or suggested.

SUMMARY OF THE INVENTION

In accordance with the invention, zirconium alloys which contain at least two transition metal elements are provided. The alloys consist essentially of at least two elements selected from the group consisting of about 1 to 27 atom percent iron, about 1 to 43 atom percent cobalt and about 1 to 42 atom percent nickel, balance essentially zirconium plus incidental impurities.

The alloys in polycrystalline form are capable of being melted and rapidly quenched to the glassy state in the form of ductile filaments. Such glassy alloys may be heat treated, if desired, to form a polycrystalline phase which remains ductile. Such polycrystalline phases are useful in promoting die life when stamping of complex shapes from ribbon, foil and the like is contemplated.

Substantially totally glassy alloys of the invention possess useful electrical properties, with resistivities of over 200 $\mu\Omega$-cm, moderate densities and moderately high crystallization temperatures and hardness values.

DETAILED DESCRIPTION OF THE INVENTION

Figure 1:
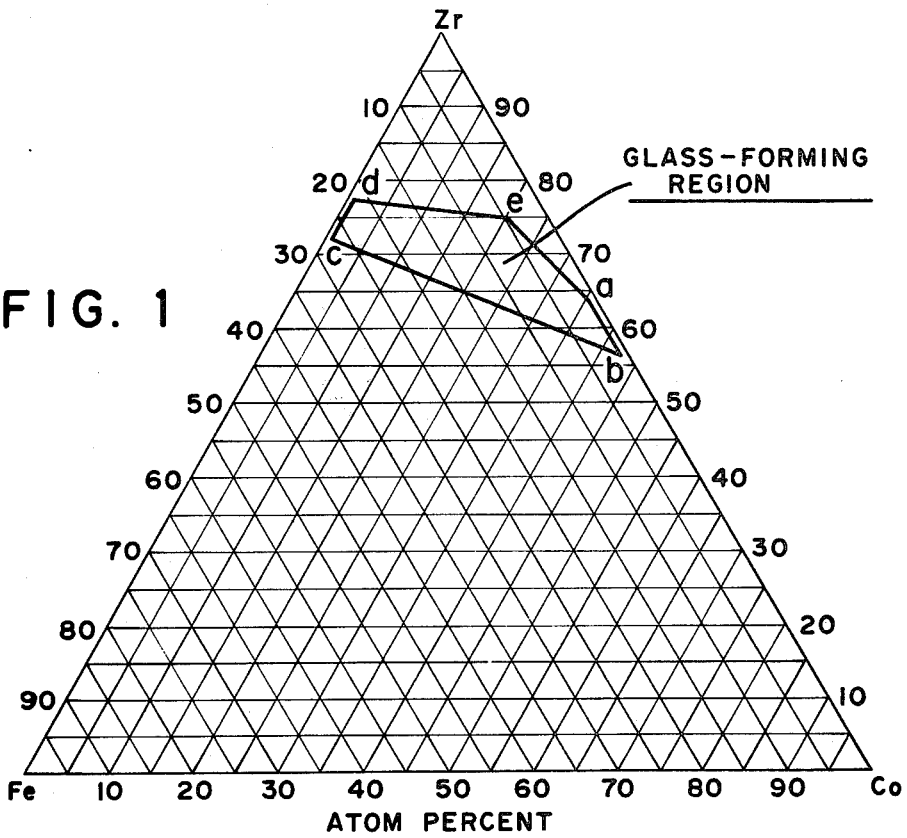
FIG. 1, on coordinates of atom percent, depicts the preferred glass-forming region in the zirconium-iron-cobalt system.

In substantially totally glassy form, the alloys of the invention find use in a number of applications, especially including electrical applications, because of their uniquely high electrical resistivities of over 200 $\mu\Omega$-cm and negative or zero temperature coefficients of resistivity. These high electrical resistivities render such glassy alloys suitable for use in various applications such as elements for resistance thermometers, precision resistors and the like.

When formed in the crystalline state by well-known metallurgical methods, the compositions of the invention would be of little utility, since the crystalline compositions are observed to be hard, brittle and almost invariably multi-phase, and cannot be formed or shaped. Consequently, these composition cannot be rolled, forged, etc. to form ribbon, wire, sheet and the like. On the other hand, such crystalline compositions may be used as precursor material for advantageously fabricating filaments of glassy alloys, employing well-known rapid quenching techniques. Such glassy alloys are substantially homogeneous, single-phase and ductile. Further, such glassy alloys may be heat treated, if desired, to form a polycrystalline phase which remains ductile. The heat treatment is typically carried out at temperatures at or above that temperature at which devitrification occurs, called the crystallization temperature. The polycrystalline form permits stamping of complex piece parts from ribbon, foil and the like without rapid degradation of stamping dies which otherwise occurs with the glassy phase.

As used herein, the term "filament" includes any slender body whose transverse dimensions are much smaller than its length, examples of which include ribbon, wire, strip, sheet and the like of regular or irregular cross-section.

The alloys of the invention consist essentially of at least two elements selected from the group consisting of about 1 to 27 atom percent iron, about to 1 to 43 atom percent cobalt and about 1 to 42 atom percent nickel, balance essentially zirconium plus incidental impurities.

In weight percent, the composition ranges of the alloys of the invention may be expressed as follows:

| | | | | | |
|---|---|---|---|---|---|
| Fe | 0.7–18 | Fe | 0.7–18 | Co | 0.7–33 |
| Co | 33–0.7 | Ni | 32–0.7 | Ni | 32–0.7 |
| Zr | bal. | Zr | bal. | Zr | bal. |

The purity of all compositions is that found in normal commercial practice. However, addition of minor amounts of other elements that do not appreciably alter the basic character of the alloys may also be made.

Preferably, the alloys of the invention are primarily glassy, but may include a minor amount of crystalline material. However, since an increasing degree of glassiness results in an increasing degree of ductility, together with exceptionally high electrical resistivity values, it is most preferred that the alloys of the invention be substantially totally glassy.

The term "glassy", as used herein, means a state of matter in which the component atoms are arranged in a disorderly array; that it, there is no long-range order.

Such a glassy material gives rise to broad, diffuse diffraction peaks when subjected to electromagnetic radiation in the X-ray region (about 0.01 to 50 Å wavelength). This is in contrast to crystalline material, in which the component atoms are arranged in an orderly array, giving rise to sharp diffraction peaks.

The thermal stability of a glassy alloy is an important property in certain applications. Thermal stability is characterized by the time-temperature transformation behavior of an alloy, and may be determined in part by DTA (differential thermal analysis). Glassy alloys with similar crystallization behavior as observed by DTA may exhibit different embrittlement behavior upon exposure to the same heat treatment cycle. By DTA measurement, crystallization temperatures $T_c$ can be accurately determined by heating a glassy alloy (at about 20° to 50° C./min) and noting whether excess heat is evolved over a limited temperature range (crystallization temperature) or whether excess heat is absorbed over a particular temperature range (glass transition temperature). In general, the glass transition temperature is near the lowest, or first, crystallization temperature $T_{c1}$ and, as is conventional, is the temperature at which the viscosity ranges from about $10^{13}$ to $10^{14}$ poise.

The glassy alloys of the invention are formed by cooling a melt of the desired composition at a rate of at least about $10^5$° C./sec. A variety of techniques are available, as is well-known in the art, for fabricating splat-quenched foils and rapid-quenched substantially continuous filaments. Typically, a particular composition is selected, powders or granules of the requisite elements in the desired proportions are melted and homogenized, and the molten alloy is rapidly quenched on a chill surface, such as a rapidly rotating cylinder. Alternatively, polycrystalline alloys of the desired composition may be employed as precursor material. Due to the highly reactive nature of these compositions, it is preferred that the alloys be fabricated in an inert atmosphere or in a partial vacuum.

While splat-quenched foils are useful in limited applications, commercial applications typically require homogeneous ductile materials. Rapidly-quenched filaments of alloys of the invention are substantially homogeneous, single phase and ductile and evidence substantially uniform thickness, width, composition and degree of glassiness and are accordingly preferred.

Preferred alloys of the invention and their glass-forming ranges are as follows:

Zirconium-Iron-Cobalt System

Compositions of the invention in the zirconium-iron-cobalt system consist essentially of about 1 to 27 atom percent (about 0.7–18 wt%) iron, about 43 to 1 atom percent (about 33–0.7 wt%) cobalt and the balance essentially zirconium plus incidental impurities. Substantially totally glassy compositions are obtained in the region shown in FIG. 1 bounded by the polygon a-b-c-d-e-a, having at its corners the points defined by (a) 64 Zr-1 Fe-35 Co
(b) 56 Zr-1 Fe-43 Co
(c) 72 Zr-27 Fe-1 Co
(d) 77 Zr-22 Fe-1 Co
(e) 75 Zr-5 Fe-20 Co.

Zirconium-Iron-Nickel System

Figure 2:
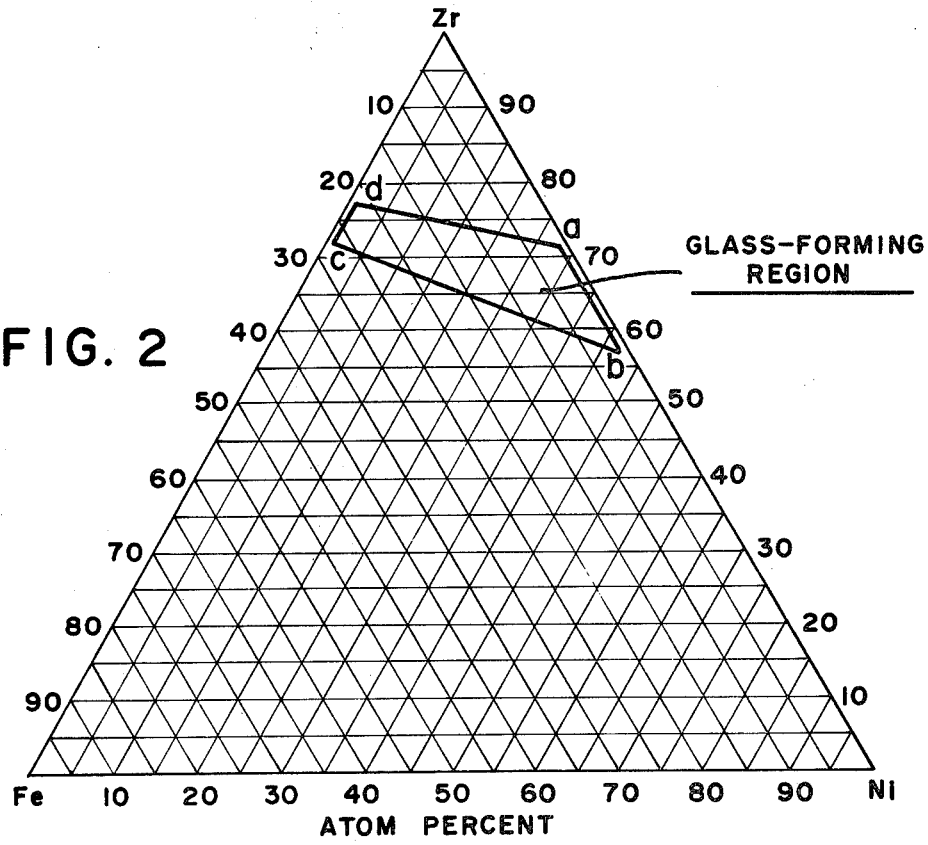
FIG. 2, on coordinates of atom percent, depicts the preferred glass-forming region in the zirconium-iron-nickel system.

Compositions of the invention in the zirconium-iron-nickel system consist essentially of about 1 to 27 atom percent (about 0.7–18 wt%) iron, about 42 to 1 atom percent (about 32–0.7 wt%) nickel and the balance essentially zirconium plus incidental impurities. Substantially totally glassy compositions are obtained in the region shown in FIG. 2 bounded by the polygon a-b-c-d-a, having at its corners the points defined by (a) 71 Zr-1 Fe-28 Ni
(b) 57 Zr-1 Fe-42 Ni
(c) 72 Zr-27 Fe-1 Ni
(d) 77 Zr-22 Fe-1 Ni.

Zirconium-Cobalt-Nickel System

Figure 3:
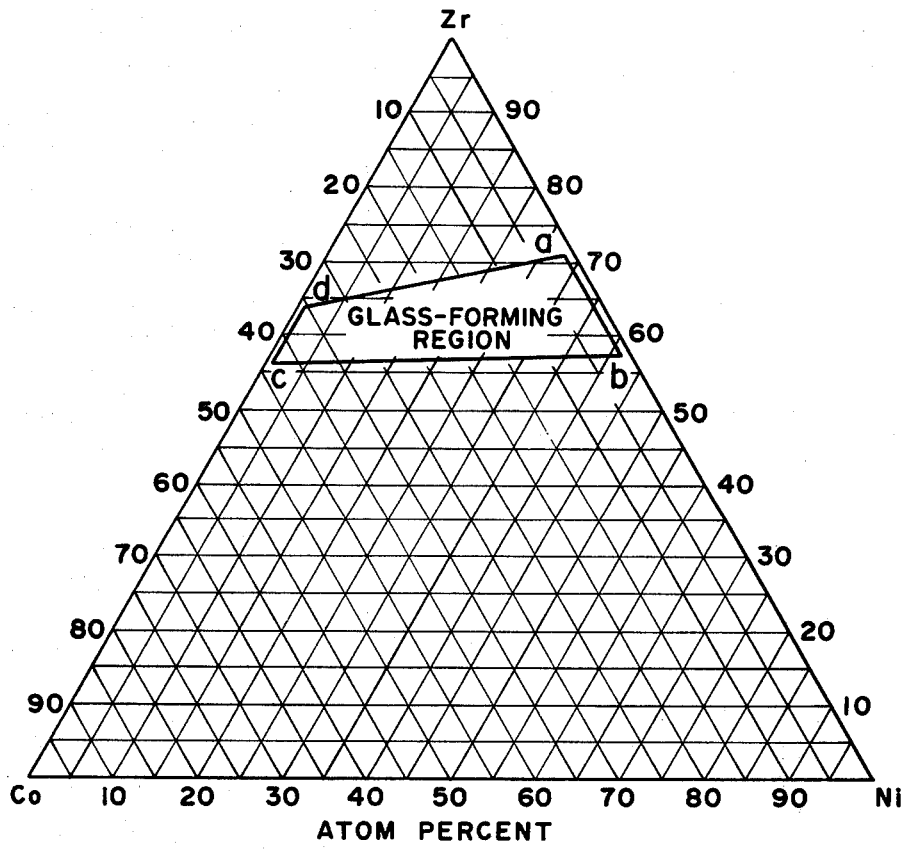
FIG. 3, on coordinates of atom percent, depicts the preferred glass-forming region in the zirconium-cobalt-nickel system.

Compositions of the invention in the zirconium-cobalt-nickel system consist essentially of about 1 to 43 atom percent (about 0.7–33 wt%) cobalt, about 42 to 1 atom percent (about 32–0.7 wt%) nickel and the balance essentially zirconium plus incidental impurities. Substantially totally glassy compositions are obtained in the region shown in FIG. 3 bounded by the polygon a-b-c-d-a, having at its corners the points defined by (a) 71 Zr-1 Co-28 Ni
(b) 57 Zr-1 Co-42 Ni
(c) 56 Zr-43 Co-1 Ni
(d) 64 Zr-35 Co-1 Ni.

EXAMPLES

Example 1

Continuous ribbons of several compositions of glassy alloys of the invention were fabricated in vacuum employing quartz crucibles and extruding molten material onto a rapidly rotating copper chill wheel (surface speed about 3000 to 6000 ft/min) by over-pressure of argon. A partial pressure of about 200 μm of Hg was employed. A cooling rate of at least about $10^5$° C./sec was attained. The degree of glassiness was determined by X-ray diffraction. From this, the limits of the glass-forming region in each system were established.

In addition, a number of physical properties of specific compositions were measured. Hardness was measured by the diamond pyramid technique, using a Vickers-type indenter consisting of a diamond in the form of a square-base pyramid with an included angle of 136° between opposite faces. Loads of 100 g were applied. Crystallization temperature was measured by differential thermal analysis at a scan rate of about 20°/min. Electrical resistivity was measured at room temperature by a conventional four-probe method.

The following values of hardness in kg/mm$^2$, density in g/cm$^3$, crystallization temperature in °K. and electrical resistivity in μΩ-cm, listed in Table I below, were measured for a number of compositions within the scope of the invention.

The temperature coefficient of resistivity for glassy $Zr_{70}Fe_{20}Ni_{10}$ was determined to be −149 ppm over the temperature range of 77° to 300° K.

TABLE I

| Composition (atom percent) | Hardness (kg/mm$^2$) | Density (g/cm$^3$) | Crystallization Temperature (°K.) | Electrical Resistivity (μΩ-cm) |
|---|---|---|---|---|
| $Zr_{70}Fe_5Co_{25}$ | 473 | 6.95 | 690 | 250 |
| $Zr_{70}Fe_{20}Ni_{10}$ | 455 | 6.89 | 670 | 220 |
| $Zr_{67}Co_{17}Ni_{16}$ | 546 | 7.05 | 708 | 251 |

Example 2

Continuous ribbons of several compositions of glassy alloys in the zirconium-iron-cobalt system were fabricated as in Example 1. Hardness values in kg/mm$^2$ (50 g load) and density in g/cm$^3$ are listed in Table II below.

TABLE II

| Composition (atom percent) | | | Hardness | Density |
|---|---|---|---|---|
| Zr | Fe | Co | (kg/mm²) | (g/cm³) |
| 65 | 5 | 30 | — | 7.11 |
| 60 | 5 | 35 | 575 | 7.30 |
| 75 | 10 | 15 | 460 | 6.89 |
| 70 | 10 | 20 | — | 7.01 |
| 65 | 10 | 25 | — | 7.12 |
| 55 | 10 | 35 | 566 | 7.32 |
| 75 | 15 | 10 | 441 | 6.78 |
| 60 | 15 | 25 | — | 7.16 |
| 75 | 20 | 5 | — | 6.87 |
| 65 | 20 | 15 | 487 | 7.18 |
| 60 | 20 | 20 | 452 | 7.14 |
| 70 | 25 | 5 | — | 6.92 |
| 65 | 25 | 10 | — | 7.07 |

Example 3

Continuous ribbons of several compositions of glassy alloys in the zirconium-iron-nickel system were fabricated as in Example 1. Hardness values in kg/mm² (50 g load) and density in g/cm³ are listed in Table III below.

Table III

| Composition (atom percent) | | | Hardness | Density |
|---|---|---|---|---|
| Zr | Fe | Ni | (kg/mm²) | (g/cm³) |
| 75 | 20 | 5 | 441 | 6.80 |
| 70 | 25 | 5 | 482 | 6.92 |
| 75 | 10 | 15 | — | 6.90 |
| 70 | 15 | 15 | 473 | 6.95 |
| 65 | 20 | 15 | 509 | 7.17 |
| 70 | 10 | 20 | 501 | 7.01 |
| 65 | 15 | 20 | 506 | 7.04 |
| 60 | 20 | 20 | 540 | 7.12 |
| 70 | 5 | 25 | 460 | 7.01 |
| 65 | 5 | 30 | 516 | 7.12 |
| 60 | 10 | 30 | 540 | 7.18 |
| 55 | 15 | 30 | 590 | 7.30 |
| 60 | 5 | 35 | 540 | 7.20 |
| 55 | 5 | 40 | 578 | 7.33 |

Example 4

Continuous ribbons of several compositions of glassy alloys in the zirconium-cobalt-nickel system were fabricated as in Example 1. Hardness values in kg/mm² (50 g load) and density in g/cm³ are listed in Table IV below.

Table IV

| Composition (atom percent) | | | Hardness | Density |
|---|---|---|---|---|
| Zr | Co | Ni | (kg/mm²) | (g/cm³) |
| 60 | 35 | 5 | 616 | 7.37 |
| 65 | 25 | 10 | 522 | 7.12 |
| 70 | 15 | 15 | — | 7.14 |
| 60 | 15 | 25 | 557 | 7.16 |

Table IV-continued

| Composition (atom percent) | | | Hardness | Density |
|---|---|---|---|---|
| Zr | Co | Ni | (kg/mm²) | (g/cm³) |
| 55 | 30 | 15 | — | 7.45 |
| 50 | 35 | 15 | — | 7.63 |
| 65 | 15 | 20 | — | 7.19 |
| 70 | 5 | 25 | 509 | 7.16 |
| 55 | 20 | 25 | — | 7.42 |
| 50 | 25 | 25 | 666 | 7.44 |
| 65 | 5 | 30 | 506 | 7.10 |
| 60 | 10 | 30 | 555 | 7.26 |
| 60 | 5 | 35 | 549 | 7.23 |
| 50 | 15 | 35 | — | 7.48 |
| 55 | 5 | 40 | 555 | 7.24 |

What is claimed is:

1. A process for preparing zirconium-base alloy comprising the steps of:

a. cooling a melt of alloy consisting essentially of a composition selected from the group consisting of (i) zirconium, iron and cobalt which, when plotted on a ternary composition diagram in atom percent Zr, atom percent Fe and atom percent Co, is represented by a polygon having at its corners the points defined by (1) 64 Zr-1 Fe-35 Co
(2) 56 Zr-1 Fe-43 Co
(3) 72 Zr-27 Fe-1 Co
(4) 77 Zr-22 Fe-1 Co
(5) 75 Zr-5 Fe-20 Co;

(ii) zirconium, iron and nickel which, when plotted on a ternary composition diagram in atom percent Zr, atom percent Fe and atom percent Ni, is represented by a polygon having at its corners the points defined by (1) 71 Zr-1 Fe-28 Ni
(2) 57 Zr-1 Fe-42 Ni
(3) 72 Zr-27 Fe-1 Ni
(4) 77 Zr-22 Fe-1 Ni; and (iii) zirconium, cobalt and nickel which, when plotted on a ternary composition diagram in atom percent Zr, atom percent Co, and atom percent Ni, is represented by a polygon having at its corners the points defined by (1) 71 Zr-1 Co-28 Ni
(2) 57 Zr-1 Co-42 Ni
(3) 56 Zr-43 Co-1 Ni
(4) 64 Zr-35 Co-1 Ni, said cooling step being conducted at a cooling rate of at least about 105° C./sec to thereby produce a substantially glassy phase of said alloy; and b. heating said substantially glassy allow at a temperature at or above its crystallization temperature to cause said alloy to form a polycrystalline phase.

2. A process as recited in claim 1, wherein each of said cooling and heating steps is conducted in an inert atmosphere.

3. A process as recited in claim 1, wherein each of said cooling and heating steps is conducted in a partial vacuum.

* * * * *